US007410051B2

(12) United States Patent
Warlick

(10) Patent No.: US 7,410,051 B2
(45) Date of Patent: Aug. 12, 2008

(54) SYSTEM AND METHOD FOR PACKAGING COTTON SLIVER

(75) Inventor: Anderson Warlick, Gastonia, NC (US)

(73) Assignee: Magnolia Manufacturing Company, Inc., Gastonia, NC (US)

( * ) Notice: Subject to any disclaimer, the term of this patent is extended or adjusted under 35 U.S.C. 154(b) by 594 days.

(21) Appl. No.: 10/952,388

(22) Filed: Sep. 28, 2004

(65) Prior Publication Data

US 2006/0065554 A1 Mar. 30, 2006

(51) Int. Cl.
*B65D 71/00* (2006.01)

(52) U.S. Cl. ..... 206/83.5; 206/388; 206/442

(58) Field of Classification Search ..... 53/399, 53/441, 556, 586, 442; 206/83.5, 388, 446; 229/125.22; 100/3
See application file for complete search history.

(56) References Cited

U.S. PATENT DOCUMENTS

| | | | | | |
|---|---|---|---|---|---|
| 68,282 | A | * | 8/1867 | Brown | 100/3 |
| 112,140 | A | * | 2/1871 | Hadwin | 206/83.5 |
| 169,518 | A | * | 11/1875 | Brown | 206/83.5 |
| 443,620 | A | * | 12/1890 | Orr | 206/83.5 |
| 474,046 | A | * | 5/1892 | Huissey | 220/4.24 |
| 1,468,130 | A | * | 9/1923 | Angier | 206/83.5 |
| 2,127,118 | A | * | 8/1938 | Herbelin | 206/83.5 |
| 2,179,303 | A | * | 11/1939 | Sides | 206/83.5 |
| 2,199,114 | A | * | 4/1940 | Rosenberg | 131/327 |
| 2,425,301 | A | * | 8/1947 | Browner | 206/83.5 |
| 2,539,725 | A | * | 1/1951 | Caraher | 206/83.5 |
| 2,705,557 | A | * | 4/1955 | Hartman | 206/83.5 |
| 2,939,184 | A | | 6/1960 | Watson et al. | 19/159 |
| 3,119,212 | A | | 1/1964 | Zytka et al. | 53/24 |
| 3,228,166 | A | * | 1/1966 | Thiele | 53/438 |
| 3,263,281 | A | | 8/1966 | Cole | 19/160 |
| 3,339,244 | A | | 9/1967 | Van Deusen | 19/160 |
| 3,351,992 | A | | 11/1967 | Carter | 28/72 |
| 3,496,862 | A | | 2/1970 | Sowerby | 100/53 |
| 3,511,019 | A | | 5/1970 | Neitzel et al. | 53/52 |
| 3,733,769 | A | * | 5/1973 | Van Doorn | 53/397 |
| 3,968,877 | A | | 7/1976 | Mattis | 206/388 |
| 4,324,176 | A | | 4/1982 | McCormick | 100/3 |
| 4,466,535 | A | * | 8/1984 | Huson | 206/83.5 |
| 4,891,918 | A | * | 1/1990 | Wiley | 52/3 |
| 5,200,269 | A | | 4/1993 | Lukhard et al. | 428/362 |
| 5,388,687 | A | * | 2/1995 | Philip | 206/83.5 |
| 5,634,316 | A | | 6/1997 | Leifeld | 53/116 |
| 5,732,531 | A | * | 3/1998 | de Silva et al. | 53/416 |
| 5,775,058 | A | * | 7/1998 | Hirschek | 53/399 |

* cited by examiner

*Primary Examiner*—David T. Fidei
(74) *Attorney, Agent, or Firm*—K&L Gates LLP

(57) ABSTRACT

A method for packaging cotton sliver for efficient transport includes the steps of laying the sliver in a uniform-density pattern onto a bottom cap, placing a top cap on the sliver, applying pressure to the top and bottom caps to compress the sliver to a higher second density at which the compressed sliver is rigid, and strapping the compressed sliver and caps in order to form a rigid package for handling and transport. A packaging system includes an oblong can that receives the sliver, a compression baler for compressing the sliver to a high density, and a strapping apparatus for strapping the compressed sliver and caps to retain the compression.

6 Claims, 9 Drawing Sheets

SYSTEM AND METHOD FOR PACKAGING COTTON SLIVER

FIELD OF THE INVENTION

The present invention relates to a system and method for efficiently packaging cotton sliver for handling and transport.

BACKGROUND OF THE INVENTION

The process of producing yarns from staple fibers such as cotton traditionally includes as an intermediate step, between the opening and cleaning of the staple fiber and the spinning and winding of the yarn, the formation of a loosely coalescent, bulky strand of fibers known as sliver. In sliver, the cotton fibers are generally aligned in lengthwise relation, but the sliver unit does not possess any twist or strength against separation of the fibers, even against its own weight.

As those skilled in the art of yarn making will recognize, the quality of the yarn relates directly to the quality of the sliver. For instance, sliver of a uniform thickness and density forms a uniform, consistently strong yarn, while a sliver that has bumps (extra-thick regions) or voids (thinner regions) will form in the first instance a yarn of inconsistent quality. While processes have been developed that enable such imperfections to be cut from a yarn during processing, this is an inefficient process, and it is therefore desirable to minimize imperfections in the sliver. During handling, sliver is particularly susceptible to the introduction of bumps and voids because of its lack of strength and resiliency.

For those reasons, the prevailing conventional view has been that the packaging of sliver is difficult and undesirable, both because of the additional handling and movement of the sliver that would be required, and because the traditional methods of handling sliver did not lend themselves to a packaging solution. However, this convention stands at odds with modern distributed manufacturing processes. In many cases, it is considered to be more efficient to specialize the functions of a processing plant, such that a portion of the yarn making process occurs in one plant, a second portion in another, and a third portion in yet another. However, if a particular function, such as the forming of sliver, is to be specialized into a plant, it is necessary for the sliver to be transported.

Traditionally, sliver is drawn from processed bulk cotton using a draw frame, a card, or a comb, and deposited in circular rows into a cylindrical sliver can made of plastic or another durable material. These sliver cans allow large volumes of sliver to be moved without excessively handling the sliver, but they are expensive and heavy. If the distance to be traversed is small, such as different buildings in a plant complex, then the sliver could be transported in sliver cans without great difficulty. However, if the distance to be traversed is large, such as would make use of over-the-road or overseas transport, then the weight and expense of the cans, the necessity of transporting empty cans, and the minimal density of uncompressed sliver make such transport imprudent and inefficient. Concerning the expense of transporting cotton, generally the determinative factor is not the weight of the material, but the bulk.

Conventional methods of compressing cotton fiber, such as baling, have proven impractical for sliver deposited in conventional cylindrical cans. The reason for this is that the conventional pattern of deposition of sliver into a cylindrical can—essentially concentric circular rows of sliver—does not result in a substantially uniform density of sliver. Specifically, the density of sliver in the center of the can is higher than the density of sliver near the edge. If sliver in a cylindrical can is compressed to its maximum practical density at the center of the can, then the sliver at the edge is insufficiently compressed to allow the resulting compressed package to be handled. Such compression does not result in a stable package. Compression of the sliver has heretofore been thought to be impractical.

Consequently, the usual practice is to conduct substantially all of the steps by which staple fiber is processed into yarn in the same location. This is, however, an inflexible, capital-intensive, and inefficient arrangement in many cases, because of a desire on the part of yarn makers to conduct some operations, such as cleaning and carding, near the cotton gin (and therefore near the cotton fields), but other operations, such as spinning, in an area where labor or equipment costs might be lower.

What is needed is a system for and a method of packaging sliver in a manner that preserves the physical integrity of the sliver while permitting efficient transport in a compressed state, without requiring transport to be made in a sliver can.

SUMMARY OF THE INVENTION

In accordance with the aforementioned needs, the present invention includes a method of packaging cotton sliver for transport thereof. The method includes the steps of laying the sliver in a pattern having a substantially uniform first density onto a bottom cap disposed inside a substantially oblong sliver can. A top cap is then placed upon the sliver, and pressure is applied to the top and bottom caps to compress the sliver to a second density substantially higher than the first density. Preferably the pressure applied to the caps is at least 3200 psi and may be considerably higher.

At the second density, the compressed sliver is substantially rigid, solid, and capable of being handled without introducing bumps or voids or otherwise damaging the sliver. In order to retain the sliver at the second density, the compressed sliver and caps are strapped to form a substantially rigid package. The caps are preferably formed of a material, such as corrugated cardboard, fiberboard, or plastic, having a substantial rigidity that is sufficient in combination with the straps to prevent decompression of the sliver package. The caps may also be provided with recesses to locate and accommodate the strapping.

In a further step, the compressed sliver may be driven out of the sliver can as part of or subsequent to the step of compressing the sliver. Optionally, the package may be placed into a protective outer cover.

The present invention also includes a method of packaging a continuous length of cotton sliver for the transport thereof. The method of the invention includes the steps of drawing the sliver from a draw frame and laying the sliver in a pattern having a substantially uniform uncompressed density into a can that has a lengthwise dimension and a widthwise dimension, with the lengthwise dimension being substantially longer than the widthwise dimension. The can is then delivered to a compression baler, and the sliver is pushed upward from the base of the can to compress the sliver, optionally with pressure totaling 3200 psi or more, and to remove it from the can. Straps are applied to the sliver to form a sliver package and to retain the package at a desired compressed density selected to enable handling of the package.

In a further step, top and bottom caps are applied to the top and bottom of the sliver to facilitate compression and retention of compression. The caps are preferably formed of a material, such as corrugated cardboard, fiberboard, or plastic, having sufficient rigidity, in combination with the strapping, to prevent decompression of the sliver package. The caps may be provided with recesses to locate and accommodate the strapping.

For protection, the package may be placed into a protective bag.

The present invention further includes a system for efficiently packaging cotton sliver for transport thereof. The system includes at least an oblong sliver can, a baler apparatus, and a strapping apparatus. The sliver can has a widthwise dimension and a lengthwise dimension substantially greater than the widthwise dimension. The can is configured to received the sliver deposited through an open top in a uniform density and to permit a pile of accumulated sliver to be pushed upwardly therethrough during packaging.

The baler apparatus includes at least one ram configured to compress the sliver to a desired density through application of a selected pressure to a bottom surface of the sliver pile. The baler apparatus also includes a means, such as a second ram, a block, or any other suitable member, for applying counter pressure to a top surface of the sliver pile.

The strapping apparatus is configured to apply one or more straps to the compressed sliver pile to retain the compressed sliver pile in a compressed condition as a sliver package.

The present invention may also include a draw frame for producing the sliver and for directing the deposition of the sliver into the can. Also included is a conveyor for delivering a loaded can from the draw frame to the baler apparatus.

A further feature of the present invention is means for pushing the sliver package from the baler apparatus. This means for pushing may include any suitable device for applying a lateral force to the sliver package, such as a hydraulic or pneumatic piston or a conveyor.

In a further embodiment of the present invention, a sliver package suitable for efficient transport includes a substantially continuous length of cotton sliver, accumulated into a pile having an oblong footprint and a substantially uniform initial density. The pile has been compressed to a substantially higher, substantially uniform compressed density. A top cap is disposed on top of the pile, and a bottom cap is disposed on the bottom of the pile. The caps each have a footprint substantially the same as the footprint of the pile. A plurality of straps are disposed about the compressed pile and the caps in order to retain the pile in its compressed state.

The sliver package of the present invention may include a protective cover for the strapped pile. At least one of the caps may be formed of fiberboard, corrugated cardboard, or plastic. The strapped pile is preferably sufficiently rigid to be a coalescent unit.

BRIEF DESCRIPTION OF THE DRAWINGS

Further features, embodiments, and advantages of the present invention will become apparent from the following detailed description with reference to the drawings, wherein.

DETAILED DESCRIPTION OF THE PREFERRED EMBODIMENTS

Figure 1:
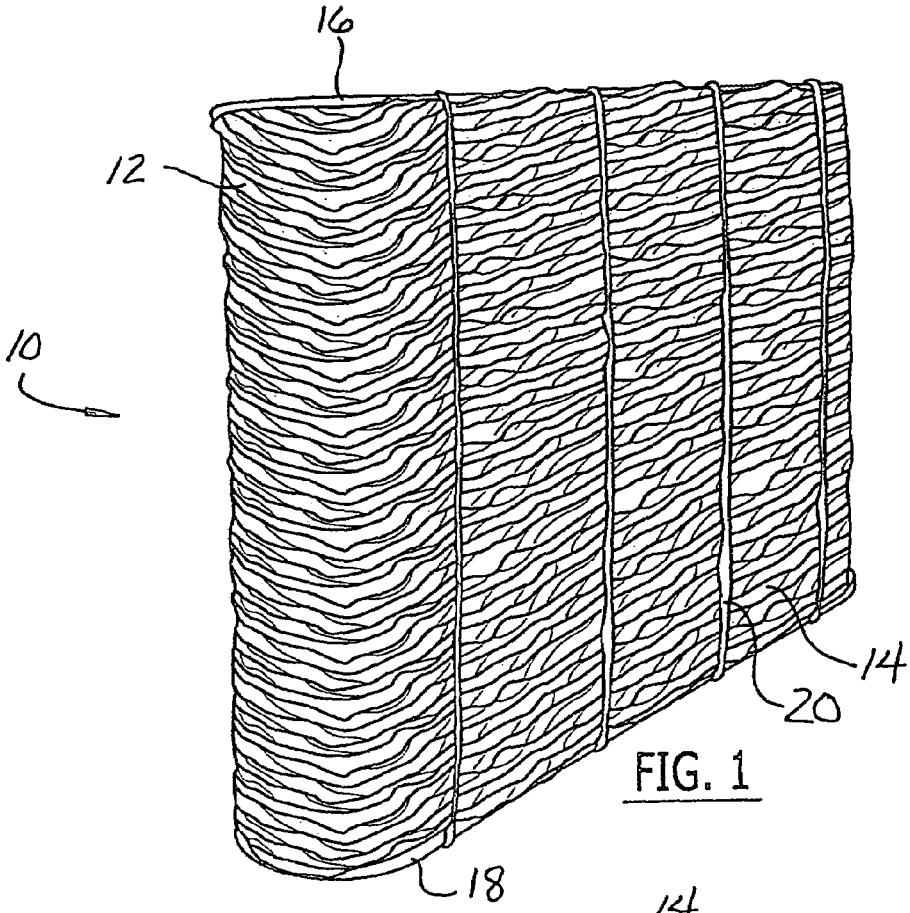
FIG. 1 is a general perspective view of a sliver package according to the present invention.
Figure 1A:
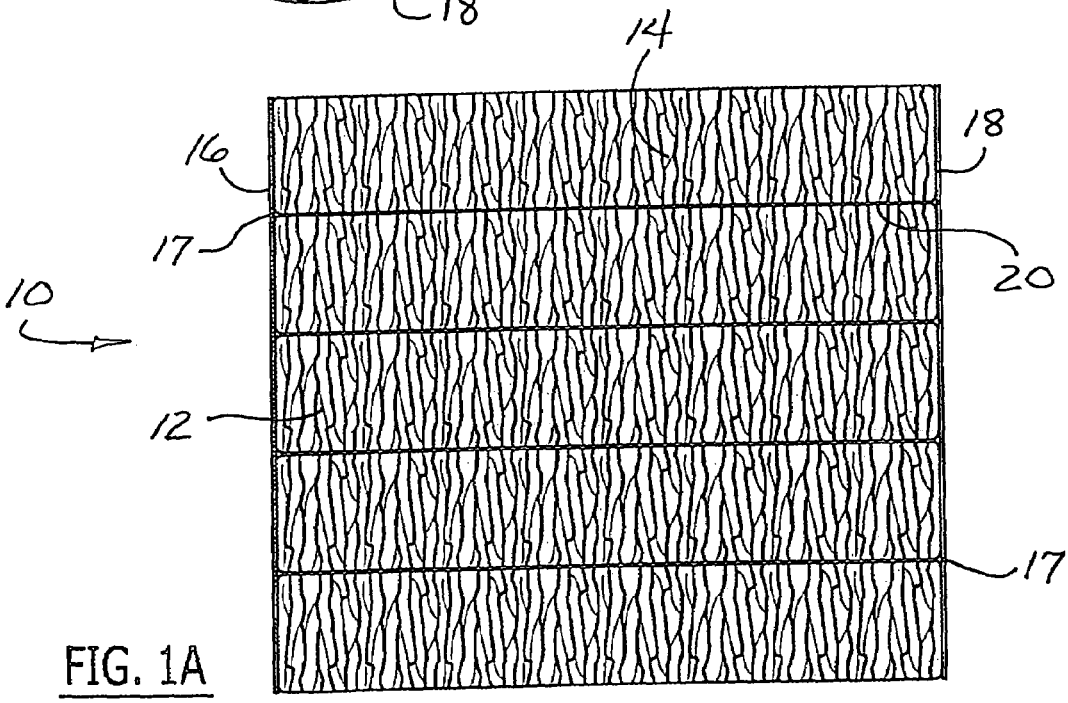
FIG. 1A is a lateral view of a sliver package as in FIG. 1.

Referring now to the drawings, FIGS. 1 and 1A illustrate, respectively in perspective and side views, a sliver package 10 according to the present invention which has been compressed and banded for efficient transport. Sliver package 10 includes a substantially continuous length 12 of cotton sliver accumulated into a pile that has an oblong footprint. The density of the pile of cotton sliver is substantially uniform throughout because the sliver draft 12 has been laid in a pattern of offset loops designed to produce a uniform density as compared to the density produced when sliver is laid with a circular footprint in conventional systems.

In FIGS. 1 and 1A, the pile has been compressed to a substantially higher, substantially uniform compressed density such that the sides 14 of the sliver package 10 are sufficiently rigid and coherent as to allow the package to be handled without damaging or disturbing the sliver draft 12 at the sides 14 of the sliver package 10. Because of the uniform density of the sliver pile as it is initially laid (in a process to be described in greater detail below), the pile may be compressed by the introduction from the top and the bottom of a compressive force, which maintains the uniformity of density of the sliver pile throughout the compression process.

The compressive force is applied, more specifically, to a top cap 16 and a bottom cap 18, which provide rigid surfaces against which the compressive force may be applied. The top and bottom caps 16, 18 are substantially similar and are preferably formed of a material such as fiberboard, corrugated cardboard, plastic, or any other suitable material of sufficient rigidity and durability the survive the compression process and to maintain the sliver package 10 in a compressed state. The top and bottom caps 16, 18 are maintained in their compressed locations by a number of straps or bands 20, formed of fiber-reinforced plastic or another suitable material, which encircle the sliver package 10 (including the caps 16, 18) and maintain the compressive force upon the caps 16, 18 and, by extension, the sliver pile 12.

The strapped sliver package 10 may be provided with a cover of polyethylene or another suitable material in order to protect the sliver from being soiled or damaged in transport. The strapped pile is sufficiently rigid, because of the uniformity of sliver density and the structural reinforcement presented by the caps 16, 18 and straps, to be a coalescent unit capable of being handled substantially without damage to the sliver. Once the sliver package 10 has been transported to the desired location, it may be unstrapped and allowed to relax, and the sliver draft 12 may be used as normal in further yarn making operations.

Figure 2:
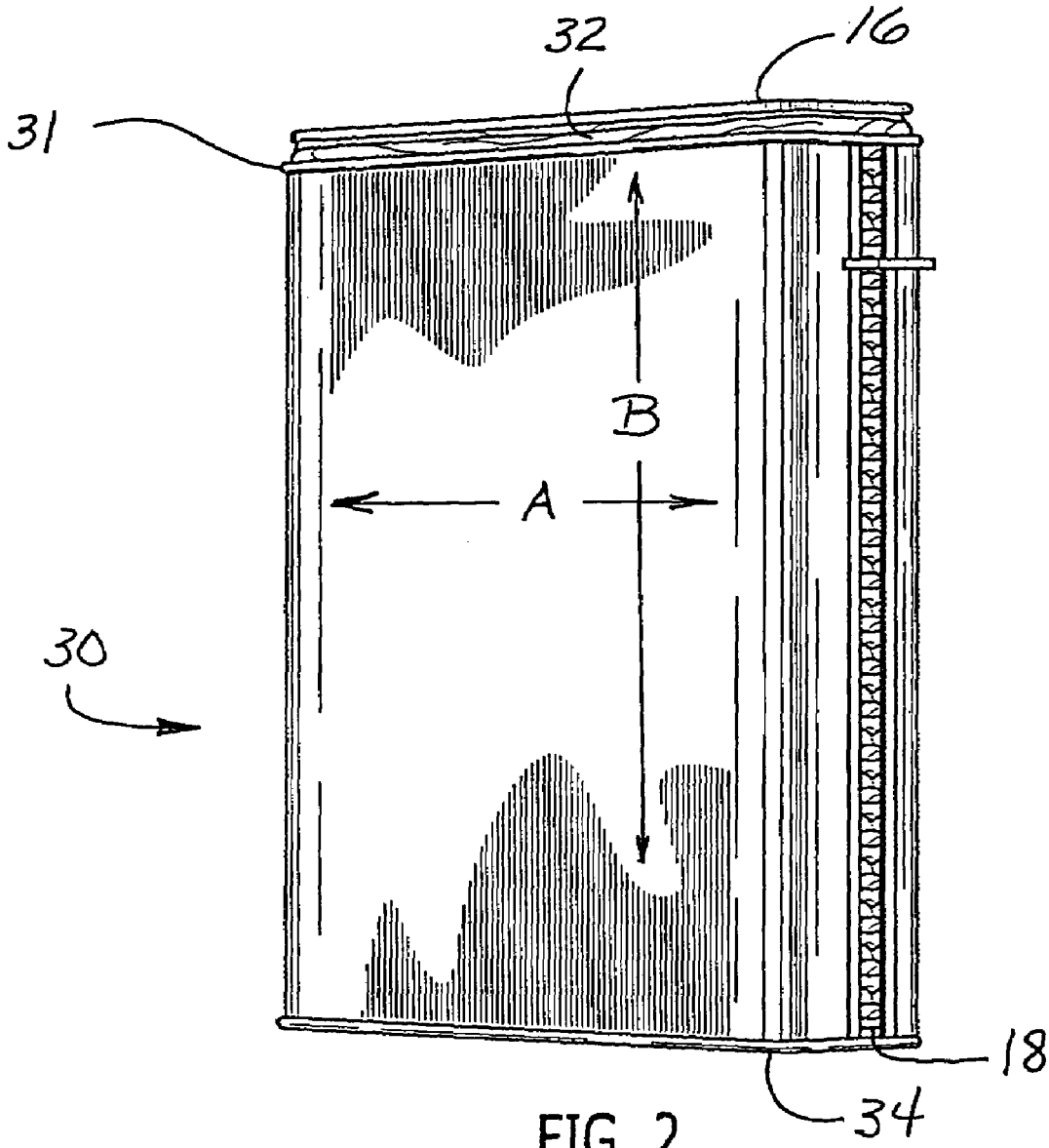
FIG. 2 is a perspective view of a loaded sliver can.

Referring now to FIG. 2, a sliver can 30 is shown in a perspective view. The sliver can has an open top 31 and has been loaded with sliver 32 drawn from a draw frame (not shown) and laid in a pattern of substantially uniform density to form a pile 12. The sliver can 30, in comparison with conventional cylindrical sliver cans, is oblong, and this oblong shape allows the sliver 32 to be laid in a pattern of offset circles that permits a substantially uniform density throughout the pile 12. The sliver can 30 is provided with an apertured base 34 that will permit, in an operation to be described later, the sliver pile 12 to be pushed upward and out of the can 30, while still providing sufficient support to retain the sliver pile 12 in the can for short-range transport. As can be seen in FIG. 2, the sliver can has a widthwise dimension A and a lengthwise dimension B that is substantially longer than the widthwise dimension A.

As part of the method of the present invention, a bottom cap 18 having an oblong footprint is placed at the bottom of the sliver can prior to filling, and this bottom cap 18 will form the base of the sliver package that is a product of the method of the present invention. The sliver 32 is then laid in the can 30 on top of the bottom cap 18. The basic elements of the package are completed by the placement of a top cap 16, having the same profile as the bottom cap 18, on top of the full sliver can 30 and the sliver 32 accumulated into the pile 12.

Figure 3:
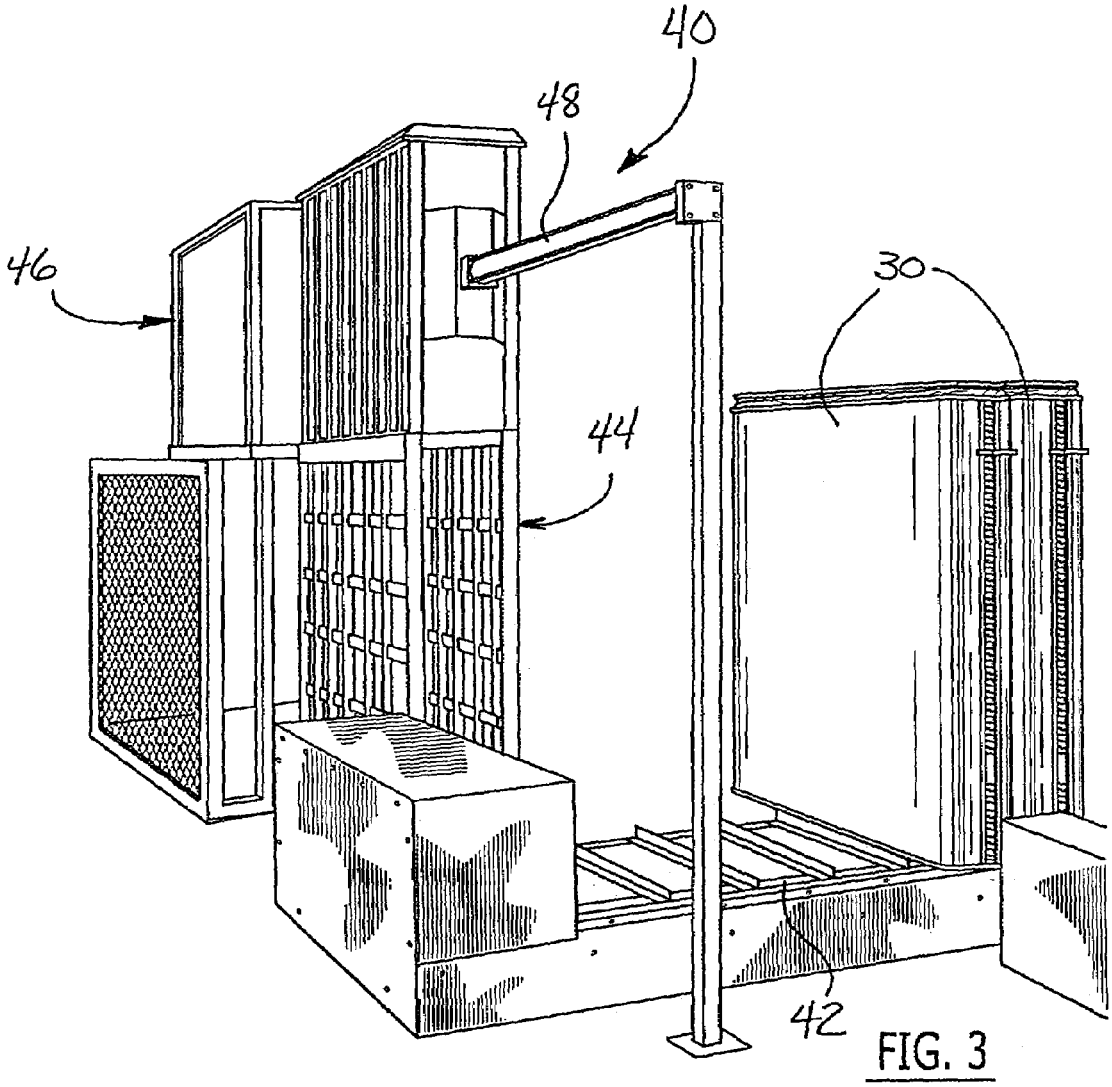
FIG. 3 is a perspective view of a packaging system according to the present invention.

The filled sliver can 30 shown in FIG. 2 is then transported to baler apparatus 40, which is shown in a perspective view in FIG. 3. The sliver can 30 is doffed from the draw frame (not shown) onto a conveyor 42, which is capable of accommodating a number of sliver cans 30 in a queue for processing. Conveyor 42 is directed at the baler apparatus 40, which includes a compression section 44, an elevator section 46, means for pushing the sliver package 10 (such as piston 48), and a second conveyor 50 (FIGS. 4A-4E) for delivering the sliver package 10 and the now-empty sliver can 30 to a collection location.

Figure 4A:
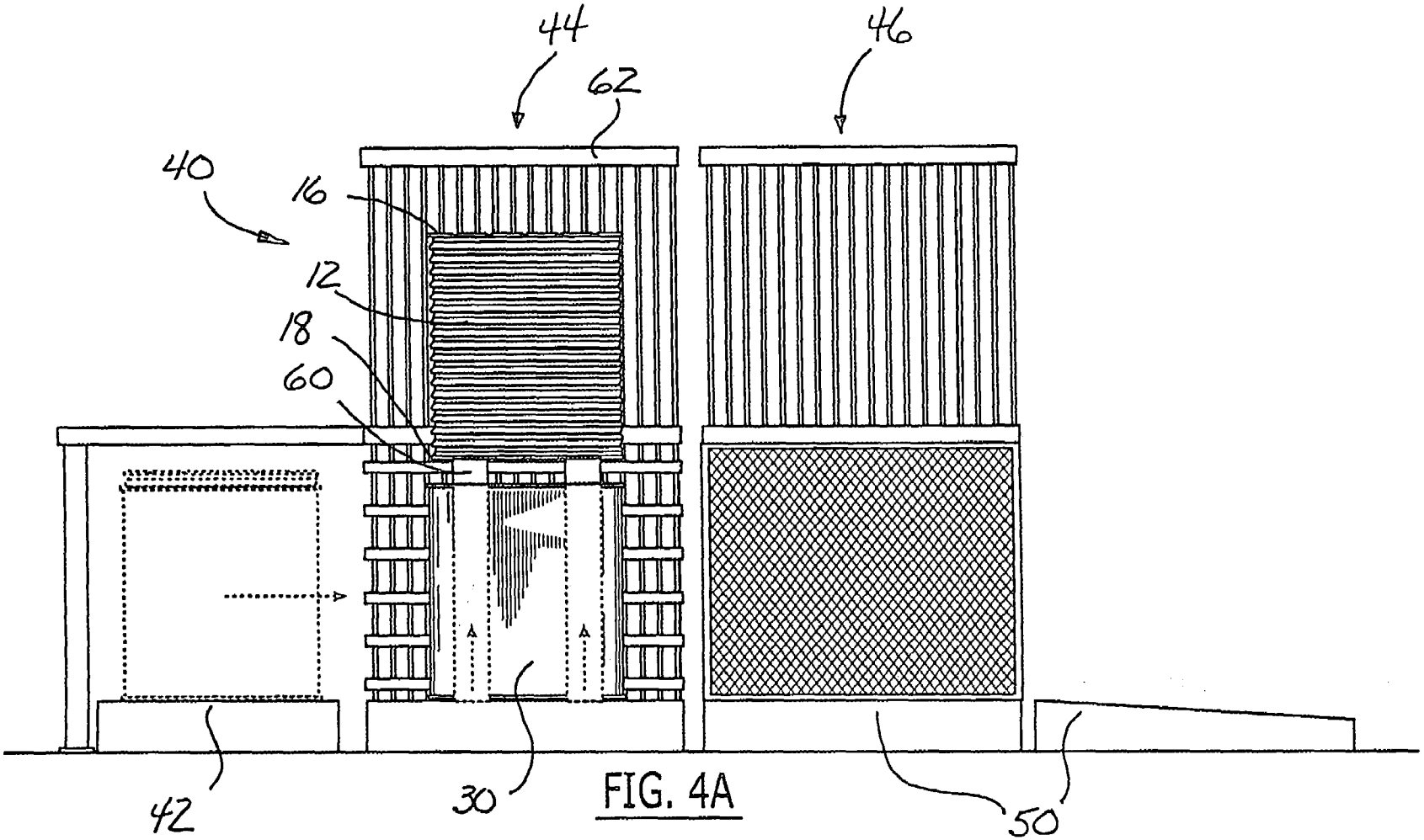
FIGS. 4A-4E are a sequence of view showing a compression method according to the present invention.

A preferred embodiment of the sections of the baler apparatus 40 are shown in greater detail in connection with FIGS. 4A-4E. FIG. 4A shows a filled sliver can 30 being deposited into the compression area 44. A ram 60 is extended through the apertures in the base 34 of the sliver can 30 and exerts an upward force upon the bottom cap 18 and thus the sliver pile 12, driving the sliver pile 12 upward against a means 62 for applying counter pressure to the top cap 16 and the sliver pile 12, such as rigid plate 62. The compression area 44 is sized to prevent the widthwise expansion or disintegration of the sliver pile 12 as it is removed from the sliver can 30. Consequently, an even pressure, preferred to be about 3600 psi or any other suitable pressure, is applied to compress the sliver pile 12 into a smaller, denser but still uniformly dense, coalescent unit 70 (see FIG. 4C).

Figure 4B:
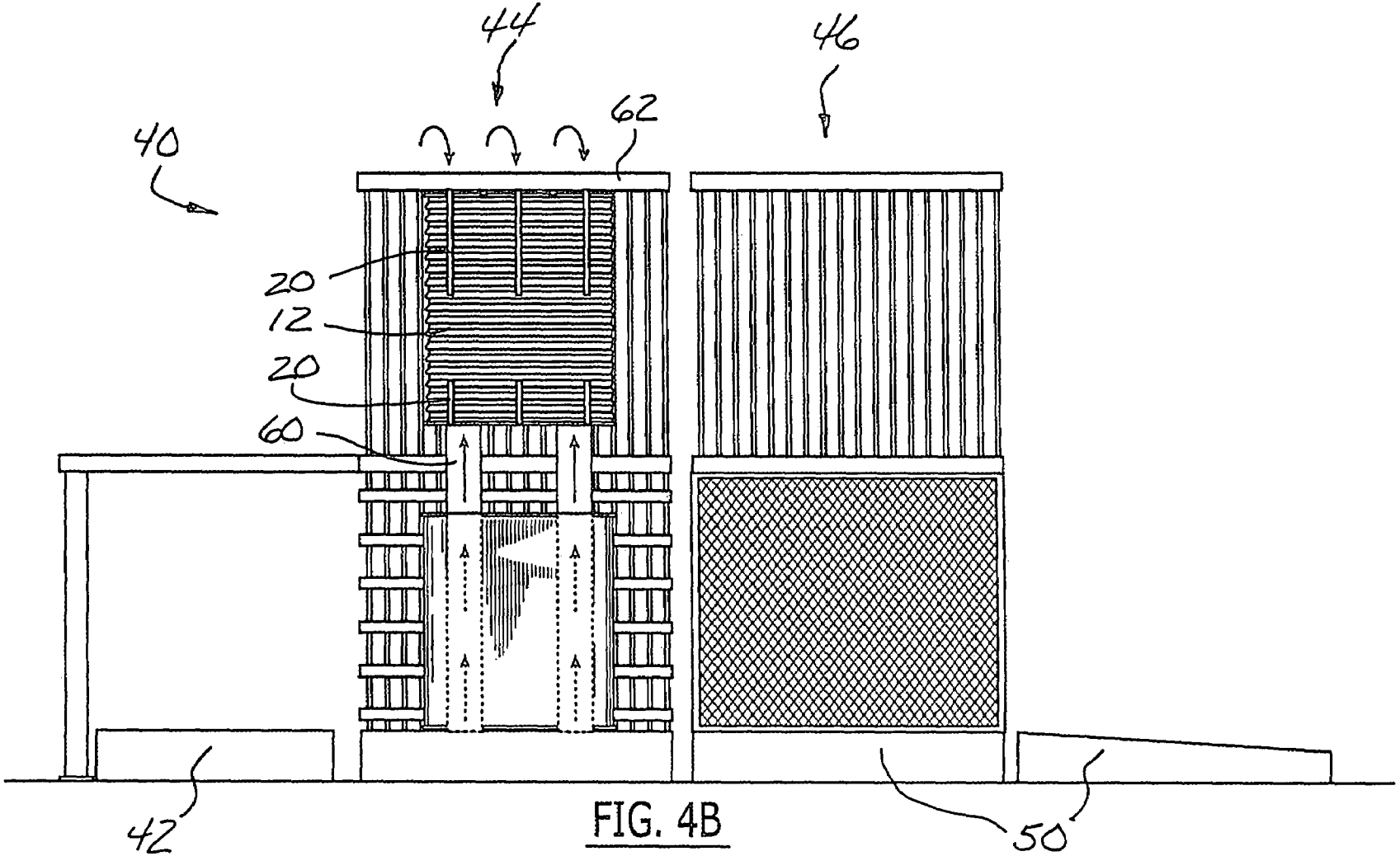
Figure 4C:
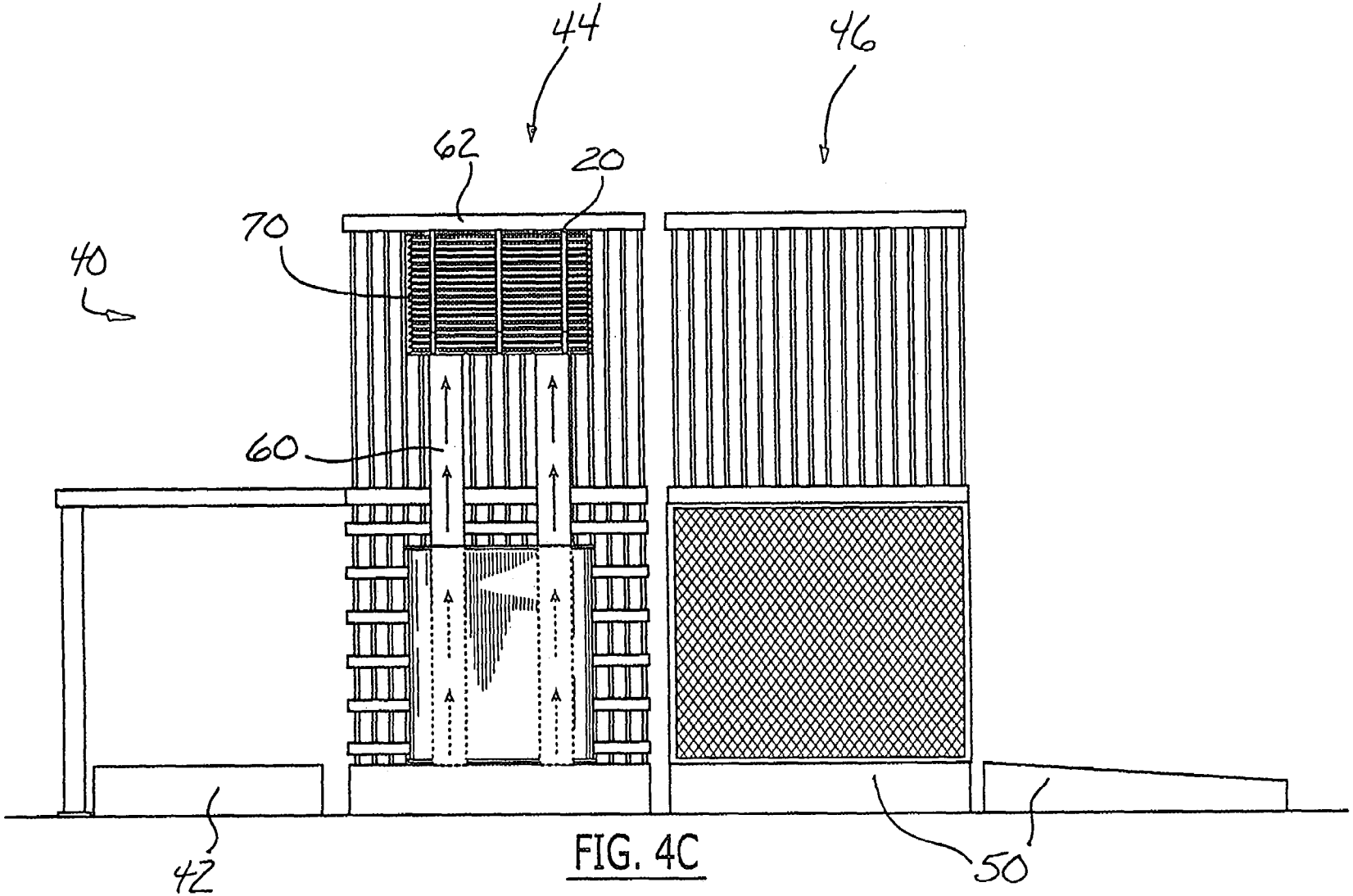

As part of the compression process, a set of straps 20 are placed about the sliver pile 12 in order to retain the coalescent unit 70 in its compressed state following compression. In FIG. 4B, these straps 20 are shown extending not quite fully around the sliver pile 12, but as the pile 12 is compressed as shown in FIG. 4C, the straps 20 may then reach completely around the sliver pile 12 and may be fastened upon each other in the conventional manner. Because the straps 20 encircle the caps 16, 18 as well, the caps 16, 18 are preferably provided with a corresponding set of recesses 17 (FIG. 1A) that locate the straps 20 in the proper place and ensure that sufficient strapping is in place to prevent the unwanted decompression of the package 70.

Figure 4D:
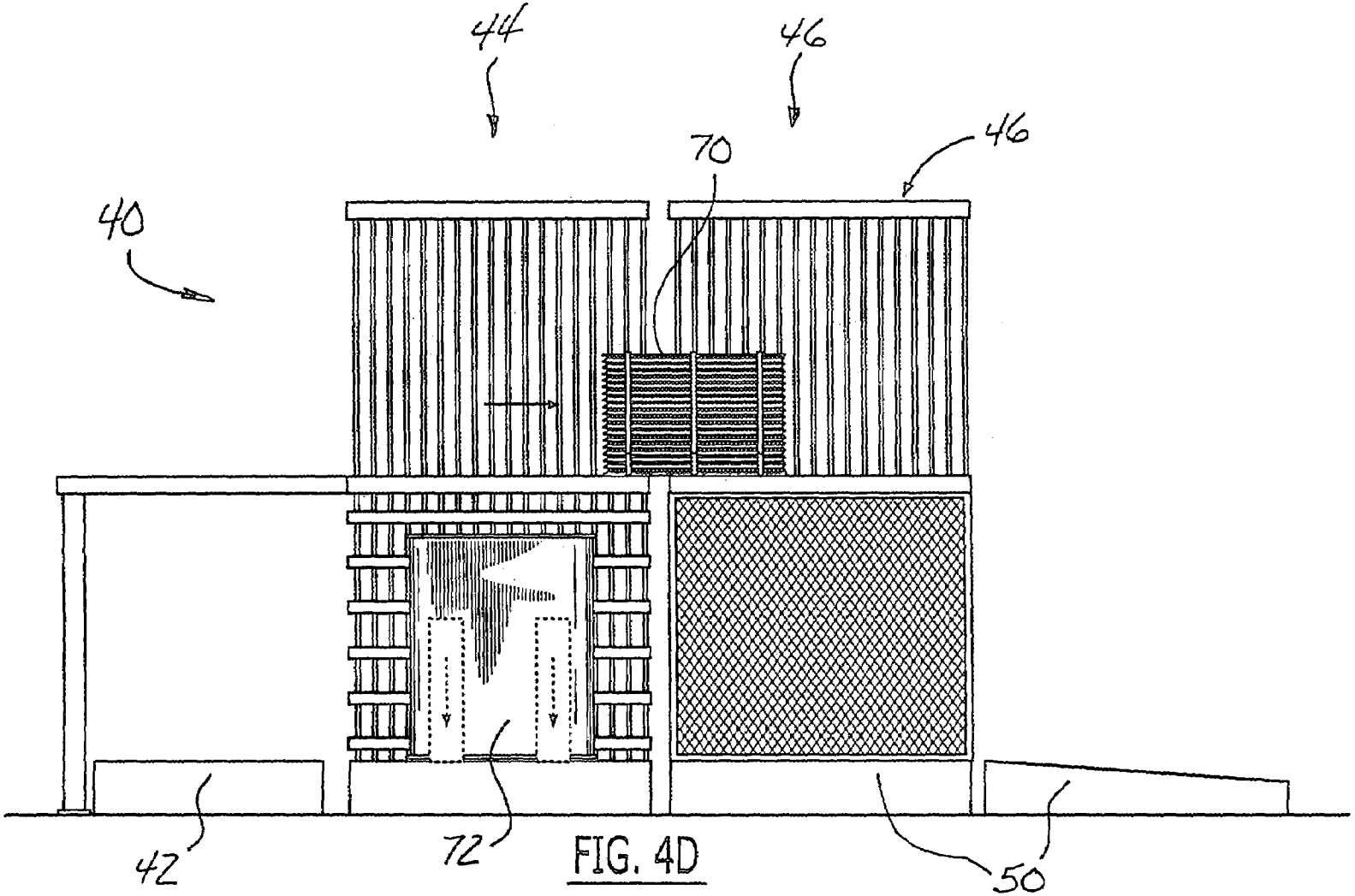
Figure 4E:
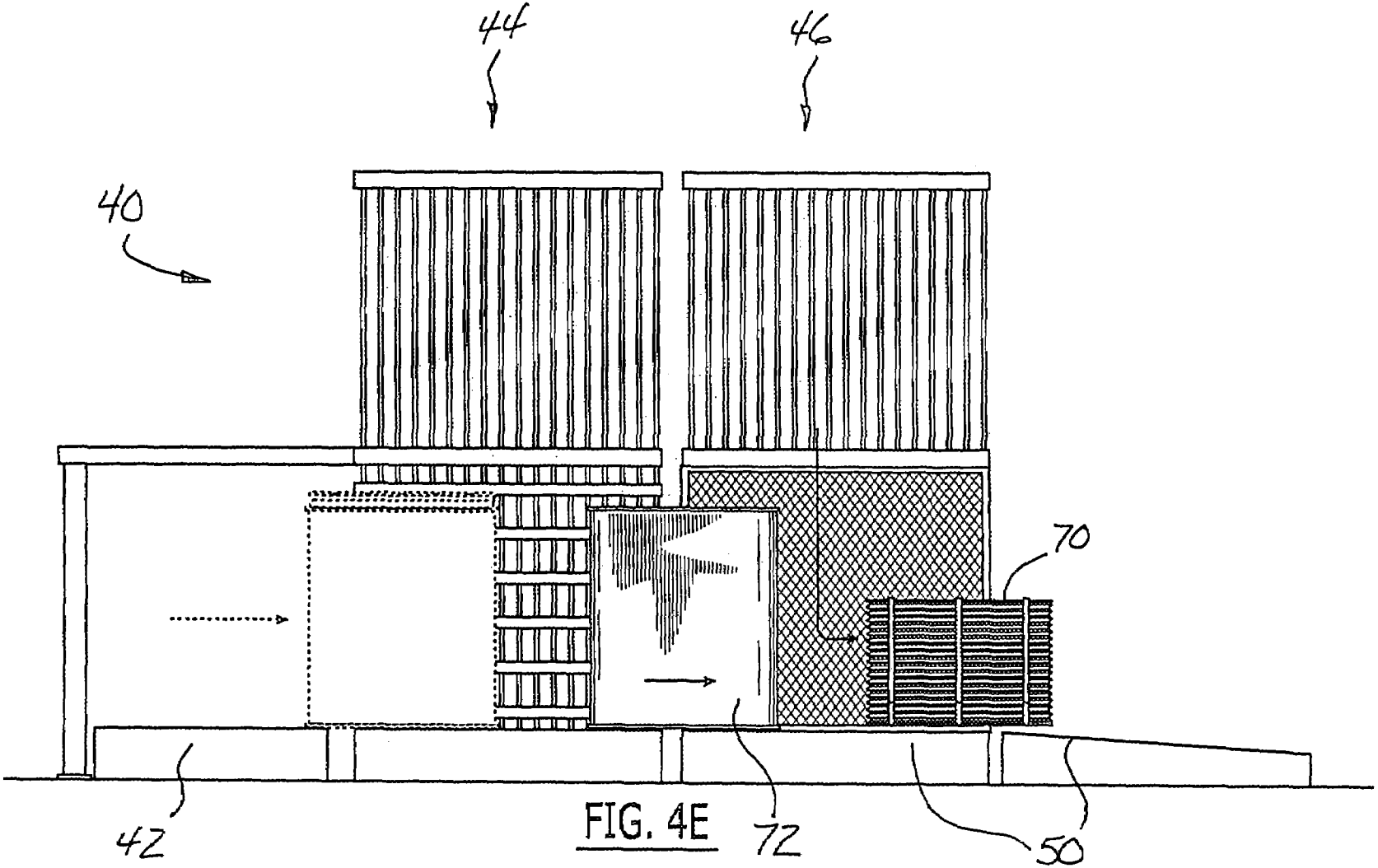

In FIG. 4D, the sliver package 70 now rests in the upper portion of the compression area 44, and the empty can 72 rests in the lower portion of the compression area 44. The sliver package 70 in a preferred embodiment is then conveyed by pushing it using a piston 48 or another suitable method to the elevator section 46 and, as can be seen in FIG. 4E, lowered to ground level to the conveyor 50 to allow the package 70 to be delivered to a collection point. Likewise, the empty can 72 may be delivered to an empty can collection point for reuse in another iteration of the method of the present invention.

Figure 5:
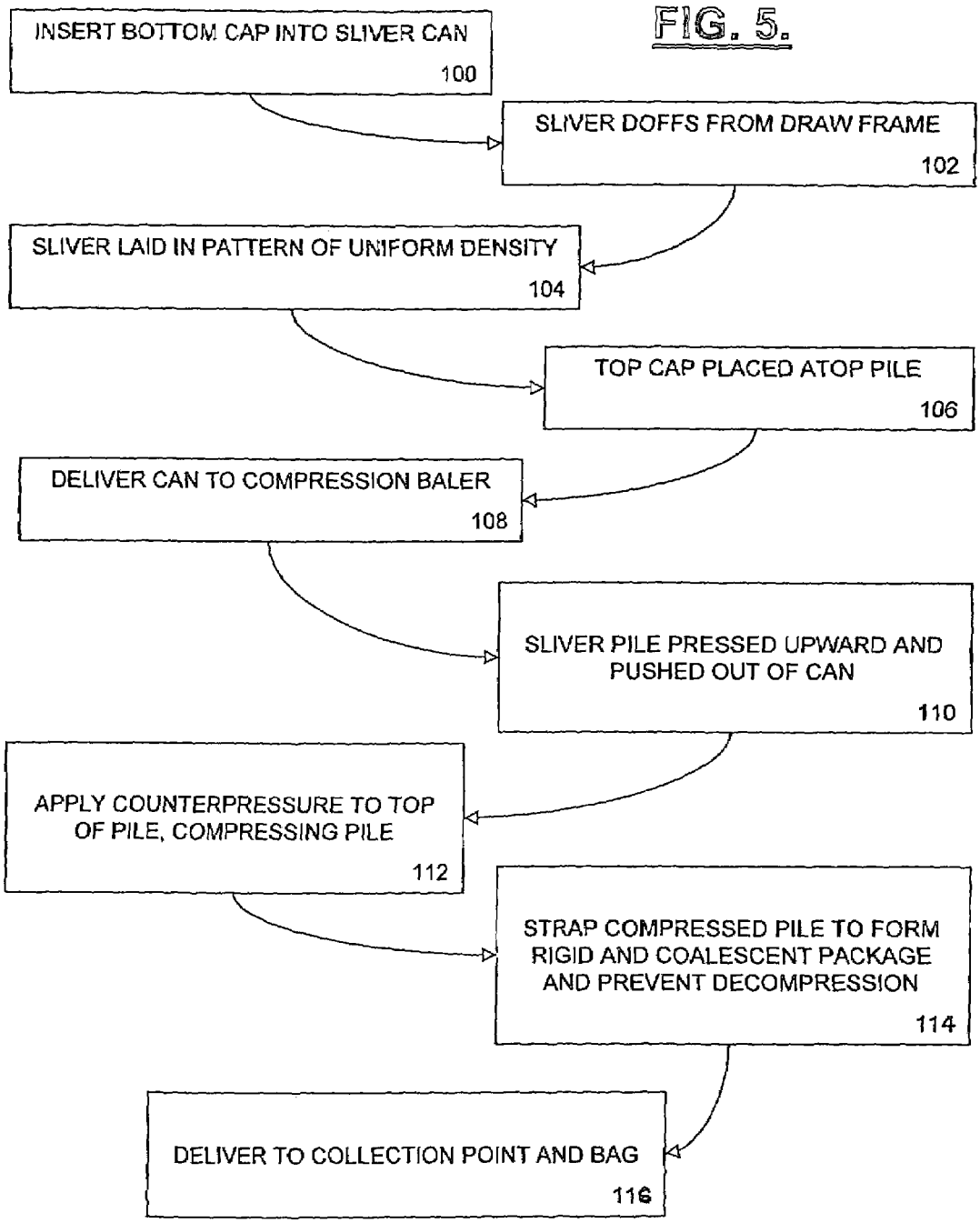
FIG. 5 is a schematic flow chart showing a compression method according to the present invention.

Referring now to FIG. 5, a preferred embodiment of a method according to the present invention is shown in a flow chart illustrating steps in the sliver package-forming process. At step 100, a bottom cap of an oblong profile is placed into a can having a lengthwise dimension and a widthwise dimension, with the lengthwise dimension being substantially longer than the widthwise dimension. In other words, the can is oblong as well. At step 102, the sliver is drawn from a draw frame in the direction of the sliver can. At step 104, the sliver is laid in a pattern having a substantially uniform uncompressed density into the can on top of the bottom cap.

At step 106, a top cap is placed upon the laid sliver pile. As has been noted above, the top and bottom caps are formed of a material of sufficient rigidity, in combination with strapping to be noted below, to prevent decompression of the sliver package. Such materials may include corrugated cardboard, fiberboard, plastic, or any other suitable material. The caps themselves may be provided with recesses for locating the straps.

At step 108, the can is delivered to a compression baler. The sliver pile is then pressed upward, driving it out of the can, at step 110. Pressure continues to be applied from the bottom; at step 112, counter pressure is applied to the top of the pile, and the pile is thus compressed via the application of at least 3200 psi thereto. At step 114, the compressed sliver and caps are strapped to form a substantially rigid and independently stable package, and the straps retain the package at a desired compressed density selected to enable handling of the package without damage to the sliver. At step 116, the sliver package is delivered to a collection point and may be bagged or covered for transport.

In view of the aforesaid written description of the present invention, it will be readily understood by those persons skilled in the art that the present invention is susceptible of broad utility and application. Many embodiments and adaptations of the present invention other than those herein described, as well as many variations, modifications, and equivalent arrangements, will be apparent from or reasonably suggested by the present invention and the foregoing description thereof, without departing from the substance or scope of the present invention. Accordingly, while the present invention has been described herein in detail in relation to preferred embodiments, it is to be understood that this disclosure is only illustrative and exemplary of the present invention and is made merely for purposes of providing a full and enabling disclosure of the invention. The foregoing disclosure is not intended nor is to be construed to limit the present invention or otherwise to exclude any such other embodiments, adaptations, variations, modifications and equivalent arrangements, the present invention being limited only by the claims appended hereto and the equivalents thereof.

What is claimed is:

1. A sliver package of suitable dimensional and structural integrity for efficient storage and transport, comprising:

a substantially continuous length of cotton sliver in the form of an elongate strand of loosely assembled untwisted cotton fibers of a substantially uniform transverse cross-section, laid in a pattern of offset loops forming consecutive loop layers extending from a bottom loop layer to a top loop layer within an oblong footprint and having a substantially uniform initial density, the layers being compressed in the direction of the layers to a substantially higher, substantially uniform compressed density while substantially maintaining the oblong footprint;

a rigid top cap having a footprint substantially the same as the footprint of the loop layers and disposed in overlying relation to the top loop layer;

a rigid bottom cap having a footprint substantially the same as the footprint of the loop layers and disposed in overlying relation to the bottom loop layer; and a plurality of straps disposed about the compressed pile and the caps for retaining the loop layers in a compressed state, the caps maintaining the compressive force on the sliver.

2. A sliver package according to claim 1, further comprising:

a protective cover for the strapped sliver.

3. A sliver package according to claim 1, wherein at least one of the caps is formed of fiberboard.

4. A sliver package according to claim 1, wherein at least one of the caps is formed of corrugated cardboard.

5. A sliver package according to claim 1, wherein at least one of the caps is formed of plastic.

6. A sliver package according to claim 1, wherein the strapped and compressed sliver forms a sufficiently rigid and stable package to enable handling without damage to the sliver.

* * * * *